US005457844A

United States Patent [19]

Hanna et al.

[11] Patent Number: 5,457,844

[45] Date of Patent: Oct. 17, 1995

[54] FLOOR CLEANING DEVICE

[76] Inventors: James M. Hanna; Beverly I. Hanna, both of 7954 Two Mile Rd., Lakeview, Mich. 48850

[21] Appl. No.: 271,442

[22] Filed: Jul. 7, 1994

[51] Int. Cl.[6] ..... A47L 13/52

[52] U.S. Cl. ..... 15/257.3; 15/257.1; 15/257.5; 15/257.8; 15/257.9; 15/245; 141/391

[58] Field of Search ..... 15/1, 104.001, 15/104.8, 257.1–257.9, 257.01, 257.05, 257.06, 245; 141/391

[56] References Cited

U.S. PATENT DOCUMENTS

| | | | |
|---|---|---|---|
| 157,009 | 11/1874 | Kramm | 15/257.5 |
| 226,877 | 4/1880 | Pierce | 15/257.5 |
| 360,453 | 4/1887 | Levy et al. | 15/257.8 |
| 380,551 | 4/1888 | Colt | 15/257.5 |
| 422,240 | 2/1890 | Marshall | 15/257.5 |
| 445,278 | 1/1891 | Chubb | 15/257.1 |
| 565,059 | 8/1896 | Williams | 15/257.5 |
| 607,309 | 7/1898 | Weir | 15/257.5 |
| 657,243 | 9/1900 | Leib | 15/257.5 |
| 805,904 | 11/1905 | Despain | 15/257.5 |
| 820,627 | 5/1906 | Curtis | 15/257.8 |
| 910,116 | 1/1909 | Christy et al. | 15/257.5 |
| 996,341 | 6/1911 | Hutchison | 15/257.7 |
| 1,225,540 | 5/1917 | Wells | 15/257.5 |
| 1,255,902 | 2/1918 | Marriott | 15/257.3 |
| 1,659,461 | 2/1928 | Curran | 15/257.2 |
| 1,908,730 | 5/1933 | Caldwell et al. | 15/257.8 |
| 1,940,546 | 12/1933 | Hower | 15/257.5 |
| 3,022,209 | 10/1961 | McKinstry | 15/257.1 |
| 3,156,941 | 11/1964 | Tomaiuolo | 15/257.9 |
| 3,408,681 | 11/1968 | Isakson | 15/257.2 |
| 5,012,542 | 5/1991 | Lynn | 15/257.9 |

FOREIGN PATENT DOCUMENTS

| | | | |
|---|---|---|---|
| 4805 | 11/1926 | Australia | 15/257.5 |
| 435142 | 2/1912 | France | 15/257.3 |
| 2594676 | 8/1987 | France | 15/257.1 |
| 361534 | 10/1922 | Germany | 15/257.1 |
| 838486 | 5/1952 | Germany | 15/257.5 |
| 3406853 | 9/1985 | Germany | 15/257.4 |
| 189994 | 12/1922 | United Kingdom | 15/257.3 |
| 268084 | 3/1927 | United Kingdom | 15/257.1 |
| 2041731 | 9/1980 | United Kingdom | 15/257.1 |
| 2168599 | 6/1986 | United Kingdom | 15/257.4 |

*Primary Examiner*—Mark Spisich

*Attorney, Agent, or Firm*—Sterne, Kessler, Goldstein & Fox

[57] ABSTRACT

A floor cleaning device for facilitating the removal of matter from a surface includes a receptacle with a resilient bottom member having substantially an arch shape with first and second opposed ends for contacting the surface. A side wall and a ramp are disposed along the perimeter of the bottom member. The ramp is oriented for having matter transported across it from the surface for deposit into the receptacle. Upon application of a force to the second end of the resilient bottom member, the first end has increased contact with the surface. In another embodiment of the invention, a resilient member has first and second opposed ends with a channel formed in the resilient member between the first and second end. A ramp on the first end is oriented for having matter transported across it from the surface for being deposited into the channel. Upon application of a force by a user to the second end of the resilient member, the first end has increased contact with the surface.

20 Claims, 4 Drawing Sheets

FLOOR CLEANING DEVICE

BACKGROUND OF THE INVENTION

1. Field of the Invention

The invention relates to a floor cleaning device and, more particularly, to a floor cleaning device having a resilient, substantially arched-shaped bottom, whereby upon application of a force to one end of the resilient bottom member, the other end has increased contact with the surface thus improving the contact between the device and a surface to be cleaned.

2. Description of Related Art

Devices for removing liquid or dry matter including dirt, dust, and dirty water from floors are well known. Typically, however, dust pans require the cumbersome use of one hand to position and hold the dust pan against the floor, while trying to mop or sweep debris into the dust pan with the other hand.

Attempts have been made to try to reduce some of the difficulties and frustration associated with floor cleaning. For example, in an attempt to limit the frequency of emptying dust pans and scrub water receptacles, a compartment or a plurality of compartments to store the collected dust or scrub water have been formed in the dust pan or scrub water receptacle. In particular, a plurality of compartments has been used to separate the clean scrub water from the dirty scrub water. Also, pivotally attached handles and wheels have been included on scrub water receptacles such that the scrub water receptacle can be carried or rolled between locations. Some dust pans have been made with a hinged scoop to serve both as a ramp for conveying dirt as well as a cover for covering a dirt compartment.

These conventional cleaning devices, however, are unable to provide sufficient contact with a floor, while having both hands free. Thus, dirt and water can wedge or pass underneath the device. In addition, the entire device may slip or move during use. It is also difficult to clean the storage receptacles of conventional cleaning devices. As well, these devices are not easily stackable for shipping or storage. Finally, these devices fail to include a means of scraping or removing excess scrub water or dirt from a mop or broom.

It is an object of the invention to provide an improved cleaning device for facilitating removal of matter from a floor or surface.

It is another object of the invention to provide a cleaning device that has improved contact with the surface, while being self-supporting so that the user has the freedom of use of both his or her hands.

It is another object of the invention to provide a means for scraping or removing excess water and dirt from a non-absorbent squeegee, mop or broom such that the squeegee, mop or broom is substantially drier and/or cleaner when it is returned to the surface.

It is another object of the invention to provide easy access for cleaning the device.

It is another object of the invention to facilitate removal of the matter from the receptacle.

It is a further object of the invention to provide a device that can be easily stacked for shipment and storage.

In order to achieve the above and other objects, and to overcome the shortcomings in previous devices, a cleaning device is provided for facilitating removal of matter from a surface. Such cleaning device includes a resilient bottom member such that upon application of a force to one end of the resilient bottom member, an other end has increased contact with the surface without occupying a user's hands or requiring strenuous bending by the user.

SUMMARY OF THE INVENTION

According to one aspect of the invention, the cleaning device for facilitating the removal of matter from a surface includes a resilient bottom member having a perimeter. The bottom member has substantially an arch shape with first and second opposed ends for contacting the surface. A side wall is disposed along a first portion of the perimeter of the bottom member. A ramp is disposed along a second portion of the perimeter. The side wall, the ramp and the bottom member define a receptacle having an open top. The ramp is oriented for having matter transported across it from the surface to the receptacle. The cleaning device is also provided with a means for accessing the second end in order to apply a force thereto by a user. Accordingly, upon application of a force to the second end of the resilient bottom member, the first end has increased contact with the surface.

According to another aspect of the invention, the cleaning device includes a resilient member having first and second opposed ends for contacting the surface such that only the free ends contact the surface. A channel is formed in the resilient member between the first and second ends. A ramp on the first end is oriented for having matter transported across it from the surface to the channel. Accordingly, upon application of a force by a user to the second end of the resilient member, the first end has increased contact with the surface.

BRIEF DESCRIPTION OF THE DRAWINGS

Preferred embodiments of the invention will be described in detail with reference to the following drawings in which like reference numerals refer to like elements and wherein.

DETAILED DESCRIPTION OF PREFERRED EMBODIMENTS

The invention is applicable to any type of cleaning of a surface. The invention can be used to clean wet or dry matter such as, for example, dirt, dust, or dirty scrub water. In addition, the invention can be used with any conventional broom or mop. However, the invention can also be used with a non-absorbent squeegee, mop or broom particularly adapted for use with the invention.

Figure 1:
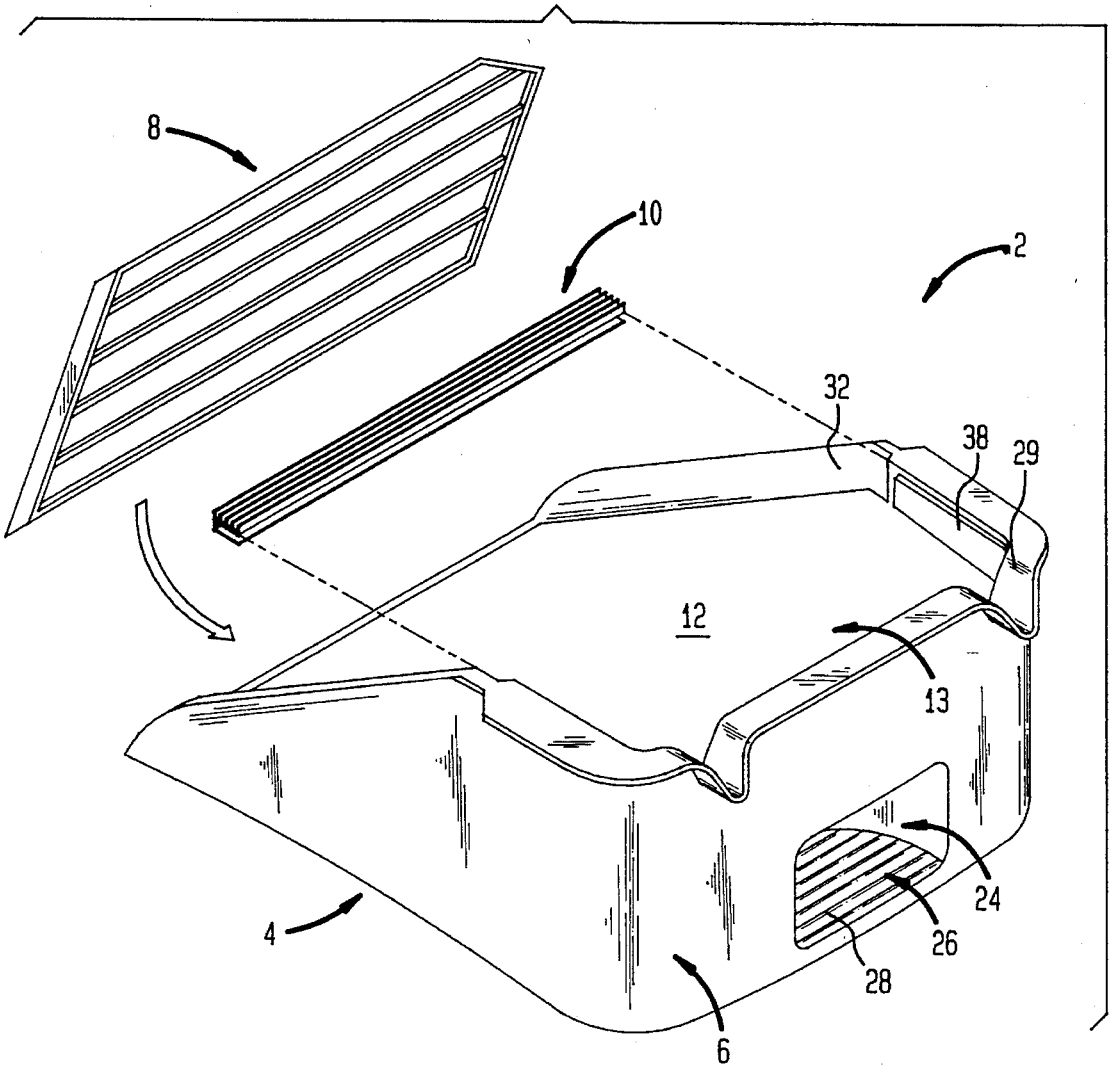
FIG. 1 is a perspective view of one embodiment of the cleaning device in accordance with the invention.

FIG. 1 illustrates a perspective view of a cleaning device 2 for in accordance with one embodiment of the invention. The cleaning device 2 includes a bottom member 4, a side wall 6, a ramp 8 and a bar 10. The bottom member 4, side wall 6 and ramp 8, in combination, form a receptacle 12 having an open top 13.

Figure 2:
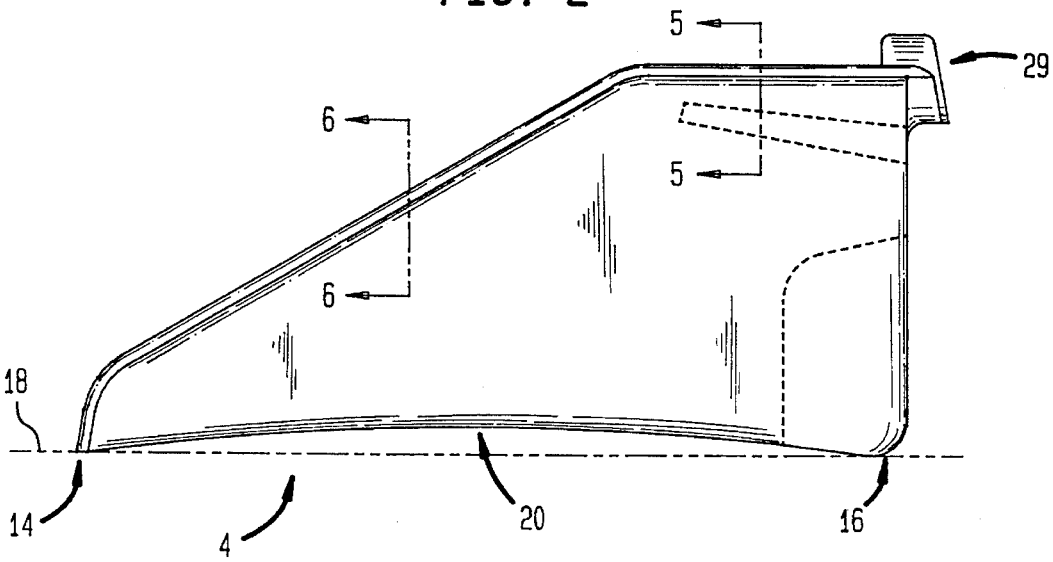
FIG. 2 is a side view of the cleaning device in accordance with the one embodiment of the invention.

As shown in FIG. 2 the bottom member 4 includes a first end 14 and a second end 16 each contacting a surface 18. A middle portion 20 of the bottom member 4 is raised from the surface 18. As shown in the embodiment in FIG. 2, the bottom member 4 has an arch shape, in particular, a gradual smooth arch shape. The arch shape of the bottom member 4 can also include, for example, an inverted V-shape arch (not shown) or a heel (as shown in FIGS. 11 and 12). Also, the arch shape of bottom member 4 can be a steep arch shape or a slightly sloping arch shape. In addition, the middle portion 20 is preferably raised approximately one half of an inch from the surface 18 at its greatest distance. However, it is within the scope of the invention to have a greater or lesser distance between the middle portion 20 and the surface 18. Accordingly, upon application of a force to the second end 16 of the resilient bottom member 4, the first end 14 has increased contact with the surface 18.

As shown in FIGS. 1 and 2, the side wall 6 is disposed along a first portion of the perimeter of the bottom member 4. The side wall 6 includes a means for accessing the second end 16 of the bottom member 4 in order to receive a force applied by a user. In accordance with one embodiment of the invention as shown in FIGS. 1 and 2, the means for accessing the second end 16 includes a recess 24. A surface 26 on the second end 16 of bottom member 4 receives the force applied by the user. The surface 26 includes ridges 28 to improve gripping or traction for the user or applier of force. In accordance with this embodiment, a foot of the user can be used to apply force to the surface 26 of the recess 24.

In addition, the side wall 6 can include pour spouts 29. In particular, when the receptacle 12 is being emptied of collected matter, the pour spouts 29 assist in controlling its exit therefrom. The pour spouts 29 are particularly useful when the collected matter is liquid.

Figure 6:
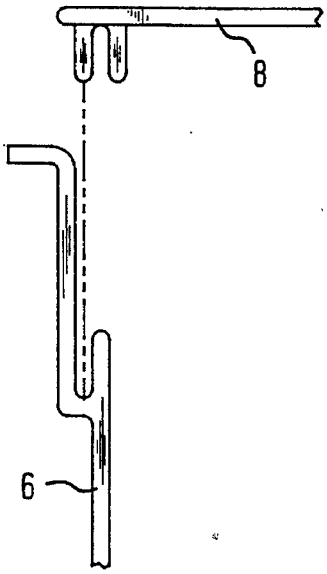
FIG. 6 is a section taken along line 6—6 shown in FIG. 3.

The ramp 8 is disposed along the second portion of the perimeter of the bottom member 4. In accordance with this embodiment, the ramp 8 is removable. The removable ramp 8 embodiment is particularly amenable to stacking, which is useful for shipping and storage. In particular, when the ramp 8 is removable, the ramp 8 can be connected to the bottom member 4 and the side wall 6 by any conventional attaching means. In accordance with the embodiment shown in FIG. 3, the ramp 8 is attached to the bottom member 4 and the side wall 6 by a pressure fit tongue and groove connection 30. In particular, FIG. 6 shows the tongue and groove connection 30 between the ramp 8 and the side wall 6. In an alternative embodiment, however, the side wall 6 and the ramp 8 can be monolithic.

Figure 4:
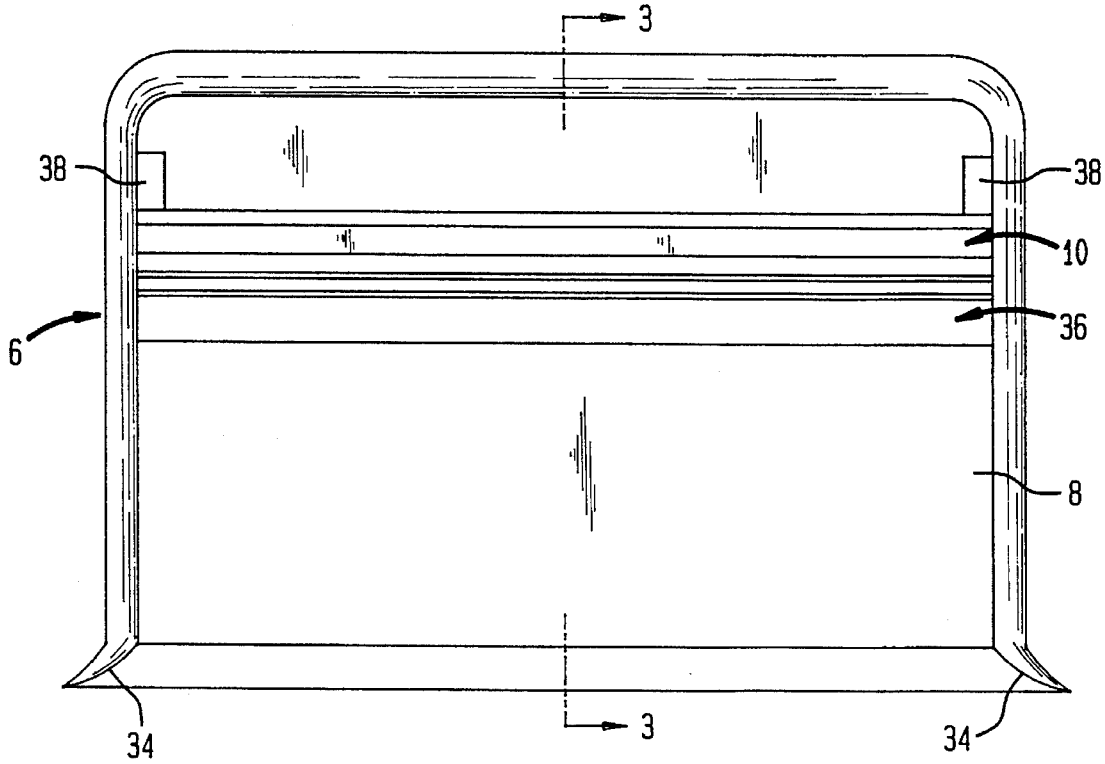
FIG. 4 is a top view of the cleaning device in accordance with the one embodiment of the invention.

In addition, as shown in FIG. 1, the sidewall 6 adjacent the ramp 8 includes side flanges 32 for retaining the matter being transported across the ramp 8. Also, the ramp 8, as best seen in FIG. 4 can have a flared portion 34. The flared portion 34 allows a mop or broom to more easily enter onto the ramp 8.

The bottom member 4, side wall 6 and ramp 8, in combination, form the receptacle 12. The receptacle 12 can be water-tight when the intended use of the cleaning device 2 involves liquid or scrub water. In addition, however, the receptacle need not be water-tight if the intended use of the cleaning device 2 is for use in collecting dirt or dry matter.

Figure 3:
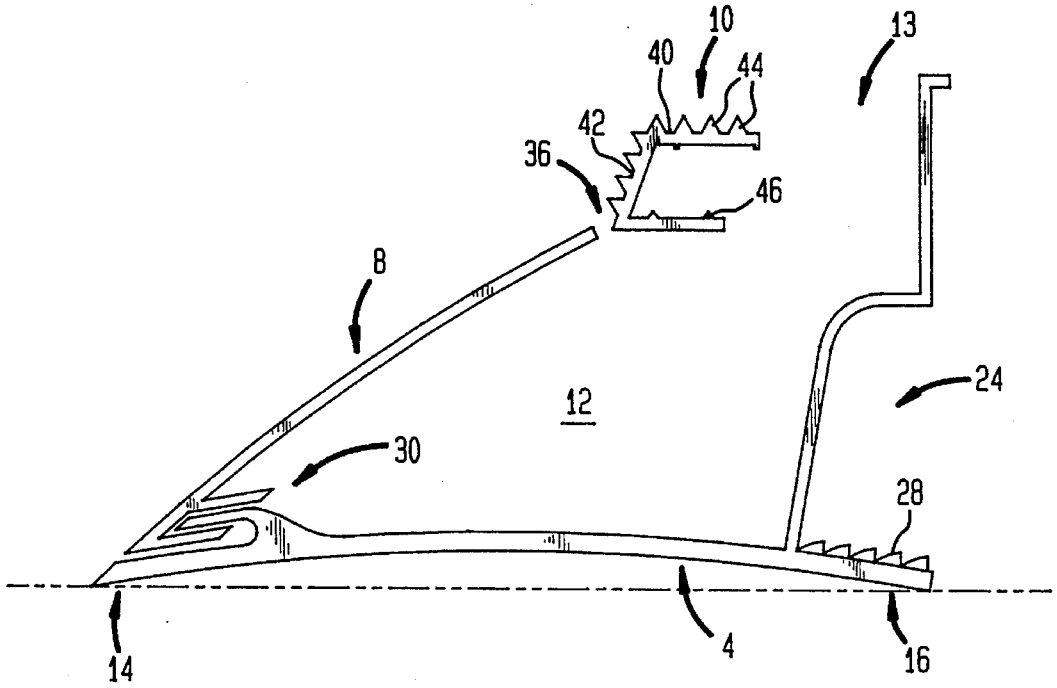
FIG. 3 is a section taken across the line 3—3 shown in FIG. 4.
Figure 5:
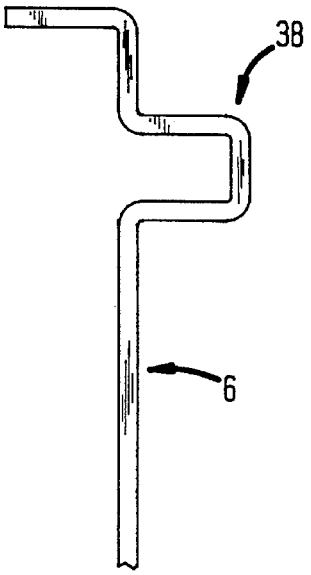
FIG. 5 is a section taken along line 5—5 shown in FIG. 3.

The bar 10 serves as a means for removing matter from a mop, broom or squeegee after the mop, broom or squeegee has guided the matter into the receptacle 12. Referring now to FIGS. 3 and 4, the bar 10 is mounted such that a space 36 is disposed between the bar 10 and a top end of the ramp 8. In this embodiment, the bar 10 has substantially a U-shaped section. Accordingly, the bar 10 can be mounted or slid onto supports 38 disposed on an inside of side wall 6. Referring to FIG. 5 momentarily, a section of the supports 38 on side wall 6 are shown. In particular, the supports 38 are integrally molded with the side wall 6. To improve the connection between the bar 10 and the supports 38, protrusions 46 can be included on an inside surface of the bar 10.

The bar 10 includes a horizontal surface 40 and a slanted surface 42. Ribs 44 are formed on both the horizontal surface 40 and the slanted surface 42. In the embodiment shown, the ribs 44 extend longitudinally on the bar 10. The bar 10 and, more particularly, the horizontal and slanted surfaces 40, 42 serve to remove excess dirt or liquid remaining on a mop or broom. As shown, the slanted surface 42 has a slightly greater incline than the ramp 8 such that the wet or dry matter more assuredly falls or drips down into the receptacle 12. In addition, it is particularly advantageous to have both the slanted surface 42 and the horizontal surface 40 on the bar 10 because a side of a mop or broom can first be cleaned as it is drawn across the slanted surface 42. Then, the end or bottom of the mop or broom can be cleaned as the mop or broom is drawn across the horizontal surface 40. However, it is within the scope of the invention to have the bar 10 comprise, for example, a flat bar having only the slanted surface 42 or the horizontal surface 40.

Figure 7:
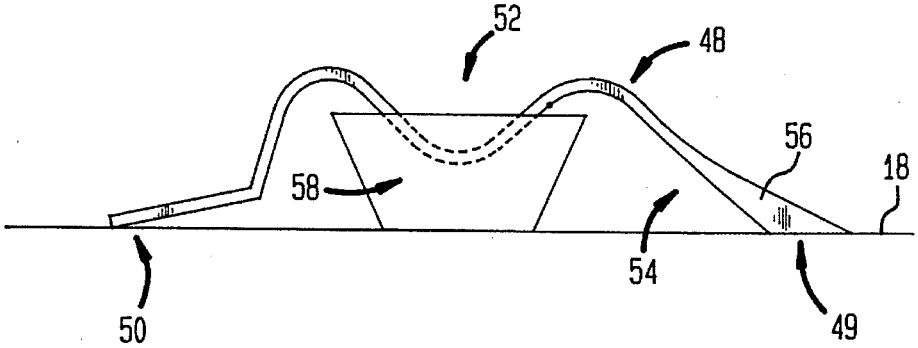
FIG. 7 is a side view of another embodiment of the cleaning device in accordance with the invention.
Figure 8:
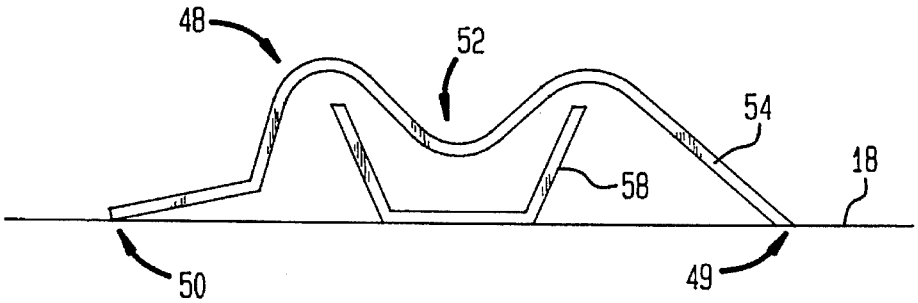
FIG. 8 is a section of the embodiment of the cleaning device shown in FIG. 7.

Referring now to FIGS. 7 and 8 another embodiment in accordance with the invention is shown. In particular, the cleaning device 2 includes a resilient member 48. The resilient member 48 includes a first end 49 and a second end 50. The resilient member 48 includes a channel 52 formed in the resilient member 48. A ramp 54 is disposed on the first end 49 and is oriented for having matter transported across it from the surface 18. The ramp 54 includes sides 56 for assisting in guiding the matter across the ramp 54. A pan 58 or similar receptacle is disposed under the channel 52 such that when the matter is transported across the ramp 54 and deposited into channel 52, the matter will drain or fall into the pan 58. Accordingly, upon application of a force by a user to the second end 50, the first end 49 has increased contact with surface 18.

Figure 9:
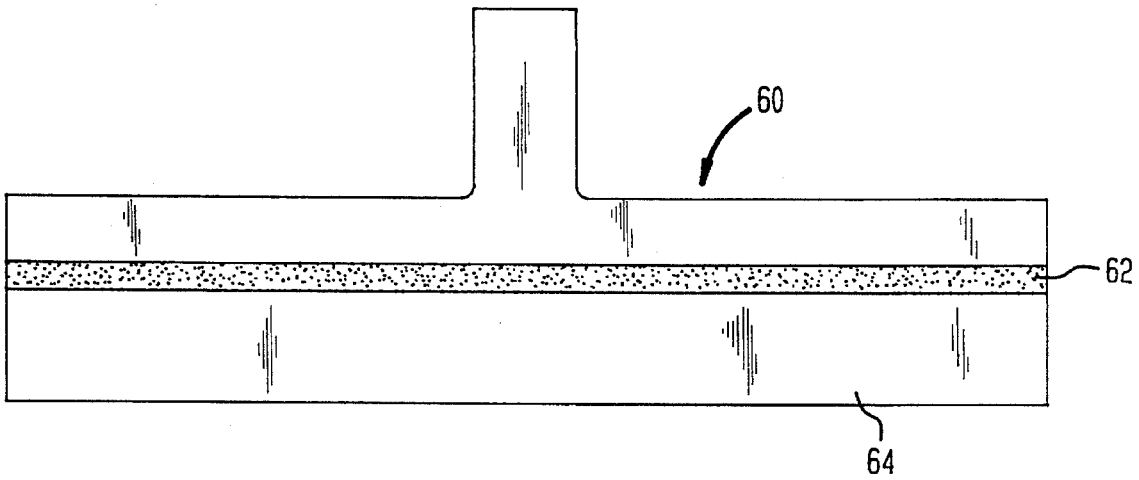
FIG. 9 is a front view of a head of a non-absorbent squeegee in accordance with one embodiment of the invention.
Figure 10:
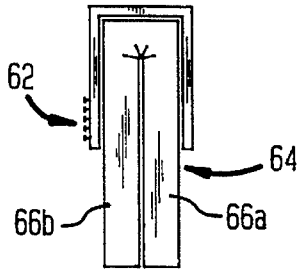
FIG. 10 is a section of the non-absorbent squeegee shown in FIG. 9.

Referring now to FIGS. 9 and 10, a preferred embodiment of a squeegee 60 in accordance with the invention is shown. In particular, the squeegee 60 is preferably of a length slightly smaller than a width of the open top 13 of the cleaning device 2. Accordingly, the squeegee 60 can be inserted into the open top 13 of the cleaning device 2 to control positioning and placement of the cleaning device 2 on the surface 18. In addition, a handle (not shown) can be attached to the cleaning device 2.

In addition, the squeegee 60 includes an attaching portion 62. Preferably, the attaching portion 62 includes hooks that can be mated with loops on an attachment. Thus, a secure, yet, versatile connection is formed between the squeegee 60 and the attachment. For example, a strip of loops can be connected to a waxing cloth, a scrubber, a sponge or a mop having strands. Thus, the same squeegee 60 can be used for multiple purposes. In addition, cellulose which is a naturally looped material can be directly attached to the attaching portion 62. A piece 64 is included in the squeegee 60. For example, the piece 64 can include closed cell foam. Although closed cell foam does not absorb water, it is effective to push or pull liquid or dry matter across the ramp. Thus, excess liquid can be removed easily from the closed cell foam by the bar 10. The piece 64 may have legs 66(*a*) and 66(*b*) which are the same length or different lengths.

While it is possible to use a mop or other device which includes an absorbent material in conjunction with cleaning device 2, the use of a non-absorbent squeegee allows the user to push water up the ramp into the receptacle. The advantage of using a non-absorbent squeegee is that dirty water can be disposed of without wringing or squeezing the water from an absorbent material. Such wringing or squeezing is time consuming. More importantly, using an absorbent mop can be unsanitary because bacteria can oftentimes breed in damp mops thereby contributing to household odors.

It is within the scope of the invention to form the cleaning device of any material and by any means of manufacturing. For example, the cleaning device can be made of plastic where at least the bottom member 4 is of a resilient plastic. In addition, in the cleaning device can be formed by preform molding.

While advantageous embodiments have been chosen to illustrate the invention, it will be understood by those skilled in the art that various changes and modifications can be made therein without departing from the scope of the invention as defined in the appended claims.

What is claimed is:

1. A device for facilitating the removal of matter from a surface, comprising:

a resilient bottom member having a perimeter with first and second opposed ends, the bottom member having substantially an arch shape with said first and second opposed ends for contacting the surface;

a sidewall disposed along a first portion of the perimeter of the bottom member, wherein said first portion includes at least said second end;

a ramp disposed along a second portion of the perimeter, wherein the sidewall, ramp and bottom member define a receptacle having an interior area and an open top, wherein the ramp has a first end adjacent the open top and a second end adjacent the bottom member and is oriented for having matter transported across it from the surface to the receptacle;

means for accessing the second end in order to apply a force thereto by a user, wherein upon application of a force to the second end of the resilient bottom member, the first end has increased contact with the surface; and an elongated bar extending across a width of the open top substantially parallel to the first end of the ramp and the bar is disposed apart from the first end of the ramp defining a space therebetween, wherein the bar has longitudinally extending ribs.

2. A device according to claim 1, wherein the means for accessing the second end is a recess in the sidewall exposing a surface of the bottom member.

3. A device according to claim 2, wherein the exposed surface of the bottom member is rough.

4. A device according to claim 1, wherein the ramp is removable.

5. A device according to claim 1, wherein the ramp and the sidewall are monolithic.

6. A device according to claim 1, wherein the receptacle is water-tight.

7. A device according to claim 1, wherein the bar has a horizontal top surface and a slanted side surface.

8. A device according to claim 1, wherein the sidewall includes a support for supporting the bar.

9. A device according to claim 8, wherein the bar is substantially U-shaped in cross-section and is slidably disposed on the support on the sidewall.

10. A device according to claim 1, further comprising:

a tool for moving the matter across the ramp, wherein a width of the open top of the receptacle is substantially equal to a width of the tool.

11. A device according to claim 1, wherein the sidewall adjacent the second end of the bottom member includes a pour spout.

12. A device according to claim 1, wherein the sidewall has an upper end adjacent the open top of the receptacle and a bottom end adjacent to the bottom member, wherein the upper end of the sidewall has flanges.

13. A device according to claim 1, wherein the bottom member has a first width at the first end and a second width at the second end and said first width is greater than the second width.

14. A device for facilitating the removal of matter from a surface, comprising:

a resilient bottom member having a perimeter with first and second opposed ends, the bottom member having substantially an arch shape with said first and second opposed ends for contacting the surface;

a sidewall disposed along a first portion of the perimeter of the bottom member, wherein said first portion includes at least said second end;

a ramp disposed along a second portion of the perimeter, wherein the sidewall, ramp and bottom member define a receptacle having an interior area and an open top, wherein the ramp has a first end adjacent the open top and a second end adjacent the bottom member and is oriented for having matter transported across it from the surface to the receptacle;

means for accessing the second end in order to apply a force thereto by a user, wherein upon application of a force to the second end of the resilient bottom member, the first end has increased contact with the surface; and an elongated bar extending across a width of the open top substantially parallel to the first end of the ramp and the bar is disposed apart from the first end of the ramp defining a space therebetween, wherein the bar is substantially U-shaped in cross-section and is slidably disposed on a support on an interior side of the sidewall.

15. A device according to claim 14, wherein the means for accessing the second end is a recess in the sidewall exposing a surface of the bottom member.

16. A device according to claim 14, wherein the ramp is removable.

17. A device according to claim 14, wherein the ramp and the sidewall are monolithic.

18. A device according to claim 14, wherein the receptacle is water-tight.

19. A device according to claim 14, wherein the bar has a horizontal top surface and a slanted side surface.

20. A device according to claim 14, wherein the sidewall adjacent the second end of the bottom member includes a pour spout.

* * * * *